US005640998A

United States Patent [19]

Schneider et al.

[11] Patent Number: 5,640,998

[45] Date of Patent: Jun. 24, 1997

[54] TUBE HAVING A HEAD OF A PLASTIC COMPOSITION INCLUDING A DETACHABLE CLOSURE

[75] Inventors: Bernard Schneider; Michel Rebeyrolle, both of Menehould, France

[73] Assignee: Cebal S.A., Clichy, France

[21] Appl. No.: 338,880

[22] Filed: Nov. 14, 1994

[30] Foreign Application Priority Data

Nov. 12, 1993 [FR] France ..... 93 13745

[51] Int. Cl.[6] ..... B65D 41/00; F16L 55/10

[52] U.S. Cl. ..... 138/89; 215/48; 215/252; 215/253

[58] Field of Search ..... 138/89, 89.1–89.4; 215/252; 253/47, 48, 50

[56] References Cited

U.S. PATENT DOCUMENTS 4,784,280 11/1988 Breuer et al. ..... 215/253 X

FOREIGN PATENT DOCUMENTS 2031040 11/1970 France .
2649676 1/1991 France .
4125987 2/1993 Germany .
1054334 11/1967 United Kingdom .

*Primary Examiner*—David Scherbel
*Assistant Examiner*—Patrick F. Brinson
*Attorney, Agent, or Firm*—Dennison, Meserole, Pollack & Scheiner

[57] ABSTRACT

A tube (1) including a head (2) of molded plastic composition and a flexible sidewall (4) affixed to this head (2), including a neck (6 and 7) with an opening (8) connected by a detachable sealed annular portion (11) to a continuous bottom (12) of a closure (20) in the form of an inverted hat topping the neck, the bottom (12) of the closure being joined to an external sidewall (13) of the closure, and the closure carrying a means (17) for reclosing the neck in a sealed manner after the detachment of said annular portion (11). The neck has an inner annular edge (7) demarcating its opening (8), the edge (7) and an annular portion (14 and 15) of the closure (20) that extends from the junction of the base (12) and the annular detachable portion (11) up to an annular portion of the external sidewall (13) located above the connection (16) of the base (12) and the sidewall (13) each have a thickness of between 1.1 and 1.6 mm, their rigidity thus promoting the detachment of the detachable annular portion (11). The invention is applicable to tubes with a detachable cover containing cream-like or paste-like products, in particular toothpaste.

13 Claims, 2 Drawing Sheets

TUBE HAVING A HEAD OF A PLASTIC COMPOSITION INCLUDING A DETACHABLE CLOSURE

The invention relates to a tube including a head of a molded plastic composition and a flexible sidewall affixed to this head, the head including a neck with an opening connected by a detachable sealed annular portion to a closure in the form of an inverted hat topping the neck, the closure having a bottom that is joined to an external sidewall and carries a means of reclosing the neck in a sealed manner after the detachment of the annular portion.

One such tube is known from French Patent A 2031040, where an annular thin-walled portion joins the neck to a cover in the form of an inverted hat. The detachment is done by a torsional movement of the hat, and the opening of the neck is thus uncapped. The hat, whose outer sidewall is substantially aligned with the body or the sidewall of the tube, thus makes it possible to reclose this neck or opening by central means for screwing to the neck or by a central projection that wedges into the opening.

The present Applicants are aware of such tubes having neck openings with a diameter equal to at most 5 mm. However, in the case of toothpaste tubes, an opening 5 mm in diameter is too small for proper distribution of the paste, and openings that are markedly larger, for example 8 mm in diameter, are sought.

The description in French Patent 2031040 does not enable making tubes with necks whose opening diameter is greater than 5 mm. In fact, the difficulty of detaching such a cover increases greatly with the diameter of the opening to which it is joined in a sealed fashion.

Applicants have attempted to develop a capped tube as defined above that has an easily detachable closure even if the diameter of its opening is markedly greater than 5 mm, for example being 8 mm. Preferably, the tube is economical to make and use.

SUMMARY OF THE INVENTION

The invention thus relates to a tube characterized in that the neck has an inner annular edge demarcating its opening, and that both the edge and an annular portion of the bottom of the cover extending from the junction of the detachable annular portion to the lower part of the external sidewall of the closure each have a thickness of between 1.1 and 1.6 mm, their rigidity thus promoting the detachment of this detachable annular portion.

In known capped tubes, there are no such thicknesses surrounding the annular portion that is to be detached by torsion. Twisting the closure relative to the tube typically first engenders a torsion of zones of the neck and of the closure surrounding the portion to be detached, then a supplementary torsion of this portion engendering its detachment. This increases the torque for detaching it, and the situation is aggravated when the diameter of the opening increases beyond 5 mm, which can make detaching the cover actually impossible, or in any case highly inconvenient because of the major effort that must be exerted and because of the resultant deformation of the head of the tube.

According to the invention, the portions surrounding the detachable annular portion are rigidified in such a way that it immediately undergoes the effects of the torsion. The closure is rigidified from its external sidewall serving the purpose of driving it in rotation up to its junction with the detachable portion, and the inner edge of the neck demarcating the opening along its connection with the detachable portion is also rigidified. These thus-rigidified portions have thicknesses that are preferably between 1.2 and 1.5 mm. They extend transversely relative to the detachable annular portion, thus promoting the transmission of an effective torsional moment in the manner of two vises rotating one about the other. The torsional moment for the detachment is much less, typically 1.5 to 1.8 times less, and the detachment is obtained faster, typically after less than 45° of relative rotation. One thus avoids the squirting of the product that often accompanies detachment that is forceful, because it is difficult, on a tube with a flexible sidewall.

A tube with a flexible sidewall typically has a diameter of between 20 and 60 mm, and the thickness of this flexible sidewall is less than 1 mm. The closure in the form of a large hat as in the prior art cited is aligned with the external sidewall and can thus have an external diameter that is quite different from the central detachable portion, which in practice makes it difficult to injection mold in a single operation so as to form it in one piece with the head of the tube. To achieve easier molding as well as economy of materials, the external side wall of the tube closure of the invention preferably constitutes its means for reclosing the neck after detachment of this detachable annular portion, the sidewall having an inner surface that then cooperates with the exterior of the neck, and the cover thus being a reclosing cap.

Advantageously for the sake of manufacture and for the ease of opening and reclosing, the internal surface of the external sidewall is annular-cylindrical and in cross section of the sidewall has a diameter that is 0.1 to 0.3 mm smaller than the outside-to-outside diameter of the exterior of the neck. In order that the cap, wedged slightly by force, will then hold on to the neck even if the tube full of paste is compressed in baggage, it is then highly desirable for the neck to be radially elastically swellable under the influence of an uncontrolled pressure on the tube when the tube is reclosed with the cap. To that end, the neck preferably has an outer lateral wall with a thickness between 0.7 and 1 mm and a height between 6 and 15 times this thickness. A shorter neck swells with difficulty and poorly retains the cap, while a longer neck swells too much halfway up, in the manner of a rugby ball, resulting in an inadequate locking zone inside the cap. In a valuable way, the external lateral wall of the neck has two spaced-apart annular ribs that are engaged by the cap in the reclosing position. Since the outer sidewall of the cap rubs only on these two ribs, reclosing is not impeded or prevented by possible deposits of dried paste on the outside of the neck, and the retention of the cap by the elastic swelling of the neck, already explained above, is better assured.

In another modality, the internal surface of the external sidewall has screw means which cooperate with corresponding screw means carried by the exterior of the neck when this neck is reclosed by the cover that has become a cap.

In accordance with the injection molding mode, the bottom of the closure includes, on the inside of its junction with the detachable annular portion, a central conical or frustoconical portion that comes to rest against and be inserted in the opening of the neck when the neck is reclosed by the closure after detachment of the detachable portion. In its entirety, the base of the closure rests continuously and in a sealed manner after this detachment.

The small diameter of the closure preferred in the invention requires intrinsically more tangential force for driving it in rotation. This force is, however, acceptable because of the surprising improvement in the ease of detachment resulting from the structure rigidified according to the invention.

In its various features, the tube of the invention is more particularly valuable when the opening has a diameter of between 6 and 13 mm, and the outer sidewall of the closure has an outside-to-outside diameter of between 1.3 and 2 times the diameter of the opening. It creates a new field of definition of tubes with a closure of a plastic composition that is detachable by rotating the closure, in the case of "large" openings (diameter of 6 to 13 mm).

In the case of the example that is described hereinafter, the external diameter of the outer sidewall of the cover, except for the ribs, is 12.5 mm. The closure is normally locked by two or three fingers, and this example will illustrate the value of the following two preferred provisions, which are meant to make grasping the cover with the fingers easier and more effective:

to prevent the fingers from sliding around the closure, its outer sidewall includes from three to seven spaced-apart projecting ribs on its outside, over its entire height, with rounded apexes that radially exceed its thickened annular portion and that serve to drive the closure to rotate for the detachment;

preferably, for the contact of the fingers between the projecting ribs, the outer sidewall includes on its outside, between these projecting ribs, small axial rounded ribs spaced apart between one another. From 2 to 3 rounded ribs, typically 0.4 to 0.8 mm in radial height, are thus located in the middle of each interval between two consecutive projecting ribs.

In practice and for the sake of economy, the head of the tube preferably includes an annular shoulder joining the neck to the flexible sidewall, which is of plastic composition and has a thickness of between 0.2 and 0.4 mm. The sidewall may be multilayered, with an intermediate layer acting as a barrier to oxygen and odors, with the inner and outer surface layers of plastic composition being compatible in terms of melting point with the plastic composition of the head with its cover, in the case where this head is molded onto the side wall. With a head of PE, one can have a multilayer metalloplastic sidewall made of PE/EAA/Al/EAA/PE, or even a plastic-plastic multilayer of PE/EMA/EVOH/EMA/PE, where "EAA" is a layer of ethylene and acrylic acid copolymer, EMA is a layer of ethylene and methyl acrylate copolymer, EVOH is a layer of ethylene and vinyl alcohol copolymer and Al is a layer of aluminum or aluminum alloy.

The EAA and EMA layers are adhesive.

Preferably for the sake of the cost of the tube and for the ease of removal of the closure, the head is of polyethylene or linear polyethylene with a specific mass of between 0.90 and 0.94 g/cm$^3$. This PE or linear PE can thus be called "low or medium density" PE. The choice of the melt index of the PE used for the injection molding of the head carrying its cover is valuable in two respects; it is preferably between 0.5 and 4. If it is less than 0.5, injection becomes difficult. If it is greater than 4, the stretching of the PE increases, and detachment becomes more difficult.

The annular shoulder may also have an oval or polygonal outer contour, for example rectangular or square, which is joined by any means known to one skilled in the art, including gluing, to a side wall of flexible material, such as waterproofed cardboard, metal/plastic and metal/cardboard/plastic complexes.

For the ease of detaching the annular portion joining the neck to the closure, the detachable annular portion preferably has a height of 0.3 to 0.8 mm and a minimal thickness of between 0.15 and 0.4 mm.

The invention presents the following advantages:

Ease of detachment of the closure.

Application to greater opening diameters, for example 8 or 10 mm.

Simplified structure of the closure, economical in terms of material.

Improved grasp of the closure for the detachment operation.

Reclosing by simple wedging of the closure that has become a cap.

Holding of the closure that has become a cap in the closing position, even in the case of sudden excess pressure on the inside of the tube, caused for example by an uncontrolled pressure on the side wall of the tube.

DESCRIPTION OF THE PREFERRED EMBODIMENTS

Figure 1:
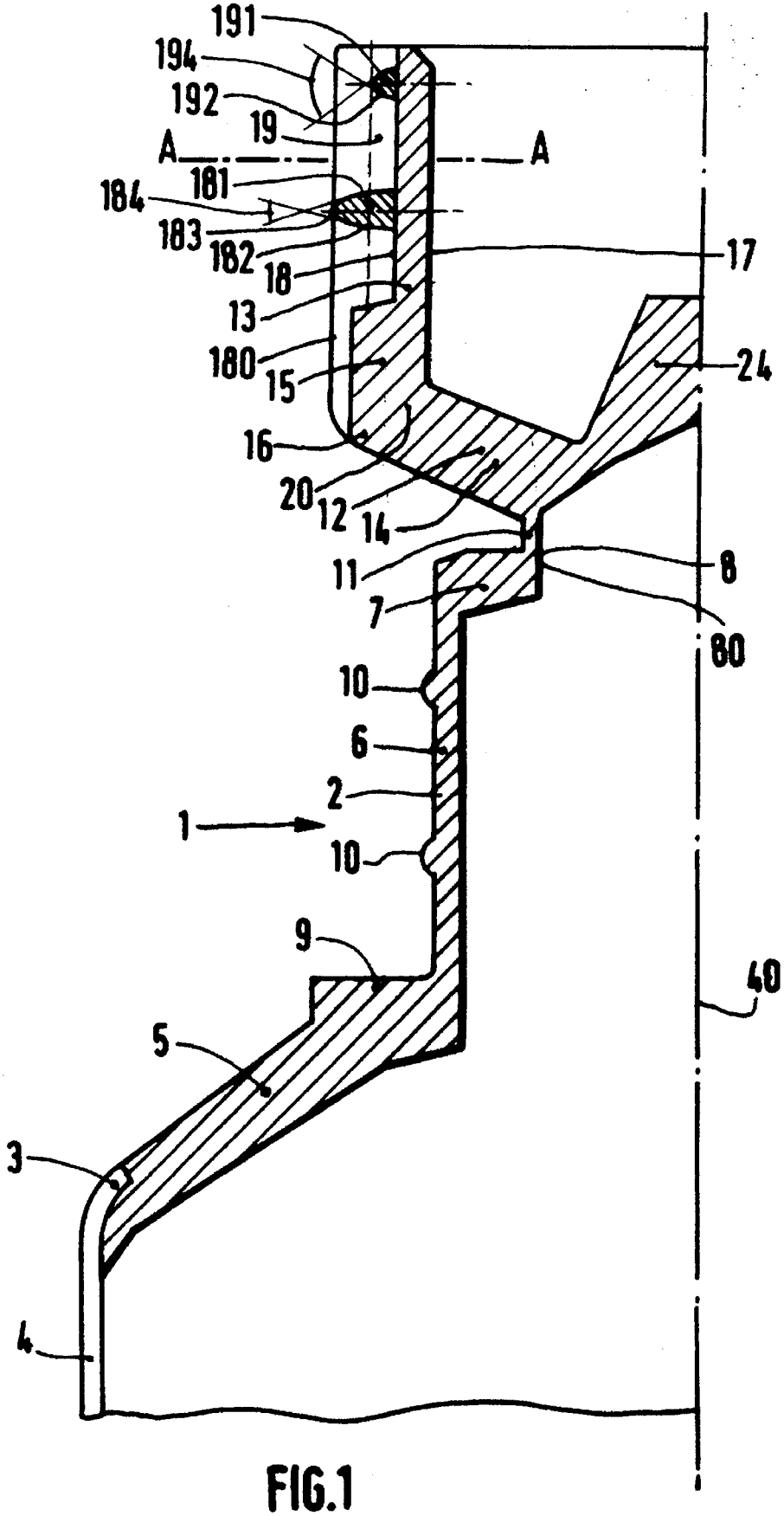
FIG. 1 shows a tube according to the invention in axial half section.

A series of more that 20 identical tubes according to FIG. 1 have been made, and several of these tubes were tested as to their usage properties: detachment of the closure and tightness of the hold of the cap on the neck under pressure on the tube. The tube (1) has a head (2) of low density (PE) (density 0.92 g/cm$^3$) with a melt index of 2 to 2.5, made by injection molding on the upper end (3) of the sidewall (4) whose thickness is 0.3 mm and whose external diameter is 35 mm, made of linear low density (PE) (density 0.92 g/cm$^3$).

The head (2), thus molded in a single operation, includes from bottom to top an annular shoulder (5) that is perfectly welded to the side wall (4) (the line of separation in the drawing shows the position of the end (3) of the side walls (4) just before molding of the head (2), and after this molding it is replaced with a continuous connection), a neck with a lateral wall (6) whose external outside-to-outside diameter is 11.5 mm and whose thickness except for the ribs is 0.7 mm, topped with an inner annular edge (7) 1.5 mm in width and 1.4 mm in thickness demarcating a central distribution opening (8) 8 mm in diameter. The edge (7) forms a rigid strong element for detaching the detachable annular portion (11).

The height of the lateral wall (6) of the neck, extending from the collar (9) at the top of the shoulder (5) to below the inner edge (7), is 9.6 mm. The wall (6) has on its outside two annular ribs (10) that are rounded and spaced apart, each with a relief of 0.1 mm relative to the remainder of the wall (6), these ribs facilitating the reclosing and effective retention of the closure that has become a cap (20) when involuntary pressure is exerted on the sidewalls (4) of the full tube (1).

Below the edge (7), the head (2) is extended by an annular portion (11) 0.5 mm in height and 0.3 mm in thickness, whose inner surface lengthens the surface (80) of the opening (8). This detachable portion (11) joins the neck (6 and 7) to the closure (20) in a sealed fashion.

The closure (20) has a bottom (12) and an external side wall (13), whose total height is 10 mm, joined to this bottom (12). An annular portion (14 and 15) of the closure extends from the junction of the bottom (12) with the detachable annular portion (11) to the side wall (13), 2.5 mm above the connection (16) of the bottom (12) and this external side wall (13) is rigidified, with a thickness of 1.4 mm.

It thus includes the circumference (14) of the bottom (12) and an annular base (15) whose external diameter is 14.1 mm. This portion (14 and 15) forms a rigid shell assuring good transmission of the rotational drive forces of the closure (20) to the detachable portion (11).

The external side wall (13) of the closure (20) has an inner axial and circular-cylindrical surface (17) that is 11.3 mm in diameter, which prepares for the reclosing of the neck (6 and 7) by direct axial driving in of the closure (20) with a tightening of 0.2 mm in diameter on the ribs (10).

The external surface (18) of the external side wall (13) has, over its entire height, three protruding axial ribs (180) spaced apart by 120°, of which a section perpendicular to the axis (40) of the tube shows the profiled straight cross section (181): Its flanks (182) surrounding its rounded end (183) form an angle (184) of between 15° and 30° between them. The protruding ribs (180) are inscribed perpendicular to the axis (40) in an outside-to-outside diameter of 15.3 mm and radially exceed the annular base (15) by 0.6 mm.

Above this base (15), the outer surface (18) has a diameter of 12.5 mm, and in the middle of the intervals separating the protruding ribs (180), it has rounded axial ribs (19), whose end is shown in dashed lines in FIG. 1, radially exceeding the surface (18) by 0.6 mm. A section perpendicular to the axis (40) shows the profile (191) of the ribs (19): Their flanks (192) surrounding their rounded end form an angle (194) between them of between 60° and 90°.

Figure 2:
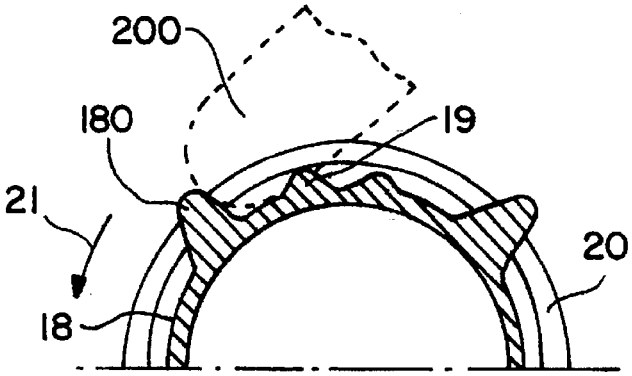
FIG. 2 shows the outer side wall of the closure in half section perpendicular to the axis along line A—A.

The role of the ribs (180) and (19) is illustrated by FIG. 2. For opening by detachment, each of the fingers (200) of the user is stopped by a protruding rib (180) and pushes on it while resting comfortably on a small rounded rib (19), driving the closure (20) in relative rotation in the direction of the arrow (21). The disposition of the ribs is adapted to a rotational drive of the cover in any direction.

The bottom (12) of the closure (20) is completed in its center by a frustoconical portion (24) that is inserted into the opening (8) when the tube is reclosed with the cap (20).

Comparative tests were done on more than 20 tubes of each type, in a condition in which they are filled with paste-like product with the end of the sidewall sealed.

Tubes according to FIG. 1

Detachment moments: 30 to 35 Ncm.

Detachment within less than 45°. The cross section to be broken in this case is 7.6 $mm^2$ in area.

Comparison prior art tubes a) Tubes with a head of the same external geometry as the preceding ones, but where the thicknesses of 1.4 mm are replaced with thicknesses of 0.8 mm, and the capped opening is 5 mm in diameter:

Detachment moments, 30 to 35 Ncm

Cross section to be broken: 4.5 $mm^2$ b) Tubes according to EP B 119 145 with a circular opening 8.7 mm in diameter joined in sealed fashion to a detachable closure with an annular detachment zone 0.3 mm in thickness, the closure having longitudinal reliefs by which it is driven in rotation by a cap 40 mm in external diameter.

Detachment moments, 50 to 60 Ncm.

These highly elevated moments cause squirting of the product during detachment, because the detachment requires additional force in grasping the tube.

c) Same configuration as in a), the capped opening being 2.5 mm in diameter:

Detachment moments, 17 to 23 Ncm

Cross section to be broken: 2.35 $mm^2$

The tubes whose opening is 8 mm in diameter according to the invention have the same detachment moment as the tubes whose opening is 5 mm in diameter not according to the invention. These tubes avoid the disadvantages of tubes not according to the invention having a comparable opening diameter.

Figure 3:
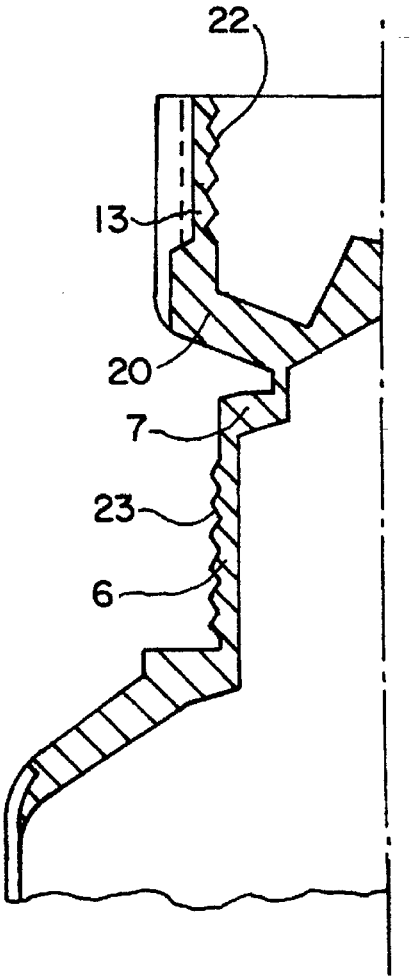
FIG. 3 shows another tube according to the invention in axial half section.

FIG. 3 shows an internal thread (22) of the external sidewall (13) of the closure (20) screwed into the external thread (23) of the neck (6 and 7) except for reclosing by the cover that has become a cap.

What is claimed is:

1. A tube comprising a head of molded plastic composition and a flexible sidewall affixed to the head, the head including a neck with an opening connected by a detachable sealed annular portion to a continuous bottom of a closure in the form of an inverted hat topping the neck, the bottom of the closure being joined to an external sidewall of the closure and the closure carrying a means for reclosing the neck in a sealed manner after the detachment of said annular portion, the neck being elastically radially swellable under the influence of an uncontrolled pressure on the sidewall of the tube when said neck is reclosed and having an inner annular edge demarcating said opening, and said means for reclosing the neck comprising said external sidewall, said sidewall having an internal surface constructed and arranged for cooperation with the exterior of the neck, said closure thus becoming a reclosing cap.

2. The tube of claim 1, wherein said internal surface is annular-cylindrical and the cross section of the sidewall has a diameter that is 0.1 to 0.3 mm smaller than the outside-to-outside diameter of the exterior of the neck.

3. The tube of claim 2, wherein the neck has an external lateral wall of thickness between 0.7 and 1 mm and height between 6 and 15 times said thickness.

4. The tube of claim 3, wherein said external lateral wall has two spaced-apart annular ribs that are engaged by said cap in a reclosing position.

5. The tube of claim 1, wherein said internal surface has screw means which cooperate with corresponding screw means carried by the exterior of the neck when this neck is reclosed by said cap.

6. The tube of claim 1, wherein the opening has a diameter of between 6 and 13 mm, and wherein said external sidewall has an outside-to-outside diameter of between 1.3 and 2 times the diameter of the opening.

7. The tube of claim 1, wherein said external sidewall includes on the exterior over its entire height from 3 to 7 spaced-apart projecting ribs having rounded apexes radially exceeding said annular portion and serving to drive the closure to rotate for said detachment.

8. The tube of claim 7, wherein the external sidewall includes on its exterior between said projecting ribs, small axial rounded ribs spaced apart from one another that improve grip on the cap.

9. The tube of claim 1, wherein the head also includes an annular shoulder joining the neck to said flexible sidewall, said shoulder being of a plastic composition and having a thickness of between 0.2 and 0.4 mm.

10. The tube of claim 9, wherein said flexible sidewall has an external diameter of between 20 and 60 mm, and wherein said head is of polyethylene or linear polyethylene with a density of between 0.90 and 0.94 $g/cm^3$.

11. The tube of claim 10, wherein said polyethylene or linear polyethylene has a melt index of between 0.5 and 4.

12. The tube of claim 6, wherein said detachable annular portion has a height of 0.3 to 0.8 mm and a minimal thickness of between 0.15 and 0.4 mm.

13. A tube comprising a head of molded plastic composition and a flexible sidewall affixed to the head, the head including a neck with an opening connected by a detachable sealed annular portion to a continuous bottom of a closure in the form of an inverted hat topping the neck, the bottom of the closure being joined to an external sidewall of the closure and the closure carrying a means for reclosing the neck in a sealed manner after the detachment of said annular portion, the neck being elastically radially swellable under the influence of an uncontrolled pressure on the sidewall of the tube when said neck is reclosed and having an inner annular edge demarcating said opening, and said edge and an annular portion of the closure that extends from the junction of the bottom and said annular detachable portion up to an annular portion of said external sidewall located above a connection of said bottom and the sidewall each having a thickness of between 1.1 and 1.6 mm, said means for reclosing the neck comprising said external sidewall, said sidewall having an internal surface constructed and arranged for cooperation with the exterior of the neck, said closure thus becoming a reclosing cap.

* * * * *